US006606839B1

(12) United States Patent
Suda et al.

(10) Patent No.: US 6,606,839 B1
(45) **Date of Patent: *Aug. 19, 2003**

(54) METHOD FOR PACKAGING AN ELONGATED ITEM

(75) Inventors: David Suda, Warrington, PA (US); Larry Clevenstine, Trevose, PA (US); Bruce Rofsky, Lafayette Hills, PA (US); Michael Lembo, Souderton, PA (US); Richard Pentz, Boyerstown, PA (US); Mark Buscher, Pine Hill, NJ (US)

(73) Assignee: Certainteed Corporation, Valley Forge, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/618,045

(22) Filed: Jul. 17, 2000

(51) Int. Cl.[7] ..... B65B 63/04
(52) U.S. Cl. ..... 53/430; 53/438; 53/459
(58) Field of Search ..... 53/430, 438, 459, 53/473, 117, 118, 530; 242/546.1, 532.6, 587.2

(56) References Cited

U.S. PATENT DOCUMENTS

| | | | | | |
|---|---|---|---|---|---|
| 437,554 | A | * | 9/1890 | Bellamy | 242/532.6 |
| 3,658,273 | A | | 4/1972 | Chapuis | |
| 3,717,973 | A | | 2/1973 | Brady, Jr. | |
| 3,971,525 | A | * | 7/1976 | Winslow | 242/470 |
| 4,198,010 | A | * | 4/1980 | Knapp | 242/532.6 |
| 4,265,414 | A | * | 5/1981 | Spradling | 242/532.6 |
| 5,177,935 | A | | 1/1993 | Jones et al. | |
| 5,799,467 | A | | 9/1998 | Nankervis et al. | |
| 5,870,885 | A | | 2/1999 | Biddle et al. | |
| 5,934,041 | A | | 8/1999 | Rudolf et al. | |
| 5,961,061 | A | * | 10/1999 | Stanley | 242/532.6 X |
| 6,098,378 | A | | 8/2000 | Wyatt | |

FOREIGN PATENT DOCUMENTS

| | | | | | |
|---|---|---|---|---|---|
| CA | 522772 | A | * | 3/1956 | 53/118 |
| GB | 448519 | A | * | 6/1936 | 53/430 |
| GB | 2140765 | A | * | 12/1984 | 53/118 |
| GB | 2265350 | A | * | 9/1993 | 53/118 |

* cited by examiner

*Primary Examiner*—Stephen F. Gerrity
(74) *Attorney, Agent, or Firm*—Oblon, Spivak, McClelland, Maier & Neustadt, P.C.

(57) ABSTRACT

A rolling apparatus including a first elongated projection, and a second elongated projection connected to a rotatably mounted shaft. The shaft is attached to a crank, motor or other device that can be used to manually or automatically rotate the shaft about an axis. A leading end of an elongated sheet of material is positioned between the elongated projections, and the elongated projections are then rotated with respect to one another about the axis of the shaft to form a rolled item. The rolled item is removed from the elongated projections by sliding the rolled item in a direction parallel to the axis. The rolled item is then inserted within an open end of a receptacle. Alternatively, the receptacle is slid over the rolled item following the rolling procedure, and prior to removal of the rolled item from the projections. Then the rolled item with the receptacle is slid smoothly off the elongated projections for further processing or sealing of the receptacle. Alternatively, a method is provided for packaging the item following the removal of the rolled item from the elongated projections using a bagging apparatus that includes a main portion having a tube section and a flared section with a wide opening. The bagging apparatus includes a receptacle receiving portion on an exterior surface of the tube section adjacent an opening thereof. The method includes positioning a receptacle over the exterior surface of the tube section adjacent the opening and inserting the item within the flared section of the bagging apparatus via the wide opening. The item is then slid through a narrow opening of the flared section, through the tube section, and within the receptacle.

5 Claims, 12 Drawing Sheets

METHOD FOR PACKAGING AN ELONGATED ITEM

BACKGROUND OF THE INVENTION

1. Field of the Invention

The present invention relates generally to an apparatus and method for rolling and packaging an item.

2. Discussion of the Background

Many manufacturing processes require that an item be rolled for various reasons during construction and packaging of the item. For example, fiberglas insulation is typically manufactured in elongated sheets of material that can be rolled prior to shipping. By rolling the sheets of insulation prior to shipping, the item can be more efficiently handled and packed for shipping. Additionally, rolled sheets of insulation provide a compact and manageable product for display and sale in a retail store. However, the inventors of the present invention have found the manual rolling of the sheets of insulation to be tedious and labor intensive work.

Additionally, in various steps of a manufacturing process it may be necessary to insert an item into a receptacle. For example, during the packaging phase the item might require insertion within a receptacle, such as a flexible sleeve or bag, in order to seal the item for shipping and for sale to the consumer. In some instances the item may be difficult to insert within the receptacle, for example, where the item is sized to fit tightly within the receptacle or where the item has edges that tend to catch on the opening of the receptacle, such as in the packaging of a rolled sheet of insulation. In such instances the process of inserting the item within the receptacle is a labor intensive process which may require more than one worker in order to successfully package the item.

Additionally, the aesthetics of the final packaged product is important, since the ultimate consumer will take the aesthetics of the final product into account during the process of deciding which product among several competing products the consumer wishes to purchase. The aesthetics of the final packaged product can, therefore, has a significant impact on the success of a product in the marketplace. Especially, when an item is packaged within a transparent packaging material. Therefore, if the item is forced into the receptacle and the product becomes damaged or appears deformed within the packaging, the consumer may decide not to purchase that product, and may opt for a competing product.

Based upon the above observations by the inventors of the present invention, the inventors have determined that an apparatus and method for rolling and packaging an item is needed that will overcome the disadvantages discussed above.

SUMMARY OF THE INVENTION

An object of the present invention is to provide an apparatus and method for rolling an item with ease and in a manner that is not labor intensive.

The present invention advantageously provides a rolling apparatus that includes a first elongated projection, and a second elongated projection. The rolling apparatus preferably has a support structure including a base and a bracket. The bracket has an upper end having a hole therethrough that receives a shaft configured to rotate within the hole in the upper end about an axis. The shaft is connected to the first and second elongated projections. The elongated projections can be symmetrically positioned about the axis such that the projections are offset from the axis by an equal distance. Alternatively, the apparatus can have projections that are offset from the axis by different distances, and/or are non-symmetrically positioned about the axis. The elongated projections are configured to rotate with respect to one another. Preferably, the elongated projections are configured to rotate in unison about the axis. In one embodiment, the shaft is attached to a crank that can be used to manually or automatically (when combined with a device for actuating the crank) rotate the shaft. Alternatively, the present invention includes a mechanized device for rotating the shaft that includes a motor configured to rotate the shaft, a controller, and an actuator.

The present invention further advantageously provides a method of rolling and a method of packaging an item. The method of rolling the item begins by inserting a leading end of an elongated sheet of material, for example a sheet of fiberglas insulation, between the first elongated projection and the second elongated projection. The elongated projections are then rotated with respect to one another about the axis of the shaft to form a rolled item. The shaft can either be rotated manually or using an device for automatically rotating the shaft. Once the item is rolled, the rolled item is removed from the elongated projections by sliding the rolled item in a direction parallel to the axis. The rolled item should slide smoothly off the elongated projections and be ready for further processing or packaging. For example, the rolled item could then be inserted within an open end of a receptacle.

An alternative method of packaging an item according to the present invention includes leaving the rolled item on the elongated projections following the rolling procedure, and sliding the receptacle over the rolled item prior to removal of the rolled item from the projections. Once the receptacle is positioned over the rolled item, the rolled item with the receptacle is slid smoothly off the elongated projections, and the receptacle and rolled item are ready for further processing or sealing of the receptacle.

A further object of the present invention is to provide a method for packaging an item by inserting the rolled item into a receptacle with ease and in a manner that is not labor intensive.

An additional object of the present invention is to provide a method for packaging an item without fraying, bending, or otherwise damaging the item. The method should provide for the neat insertion of the rolled item into the receptacle to produce a final product that is aesthetically pleasing to the consumer.

The present invention advantageously provides a method for packaging an item by inserting the rolled item into a receptacle using a bagging apparatus. The bagging apparatus includes a main portion having a tube section and a flared section. The apparatus preferably includes a receptacle configured to fit over an exterior surface of the tube section adjacent an opening. The tube section is generally hollow and has a first opening connected to the flared section, and a second opening generally configured to open into the receptacle when a receptacle is positioned on a receptacle receiving portion on the exterior surface of the tube section adjacent the second opening. The flared section is generally hollow and has a wide opening generally configured to receive an item, and a narrow opening connected to the tube section. The method for inserting an item into a receptacle is advantageous in that it provides a process for easily and neatly inserting an item into a receptacle.

The method includes the step of positioning a receptacle over an exterior surface of the tube section adjacent the second opening. The rolled sheet of material is inserted within the flared section of the bagging apparatus via the wide opening. Preferably the rolled sheet of material is inserted within the flared section while rotating the sheet of material in a direction opposite the direction that the rolled sheet of material is rolled during formation of the rolled sheet of material, such that an exterior terminal edge of the rolled sheet of material is maintained flat against the exterior surface of the rolled sheet of material. By using this method, the final product will be aesthetically pleasing to a consumer, since the rolled sheet of material will be neatly inserted into the receptacle without any frayed or deformed edges. The rolled sheet of material is then slid through the narrow opening of the flared section, through the tube section, and within the receptacle. In order to produce a product that is aesthetically pleasing to a consumer, the method further includes the step of aligning the rolled sheet of material at a predetermined orientation within the receptacle. This can be carried out by either rotating the rolled sheet of material while it is in the tube section or while it is in the receptacle. The rolled sheet of material can be oriented at a predetermined orientation, for example, by orienting the exterior terminal edge at a predetermined position with respect to the indicia on the receptacle. For example, by placing the exterior terminal edge at the rear of the receptacle, the consumer will view a smooth surface of the rolled sheet of material on the front of the receptacle where the labeling indicia is present. Once the rolled sheet of material is positioned within the receptacle, the open end can be sealed to form the final product.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
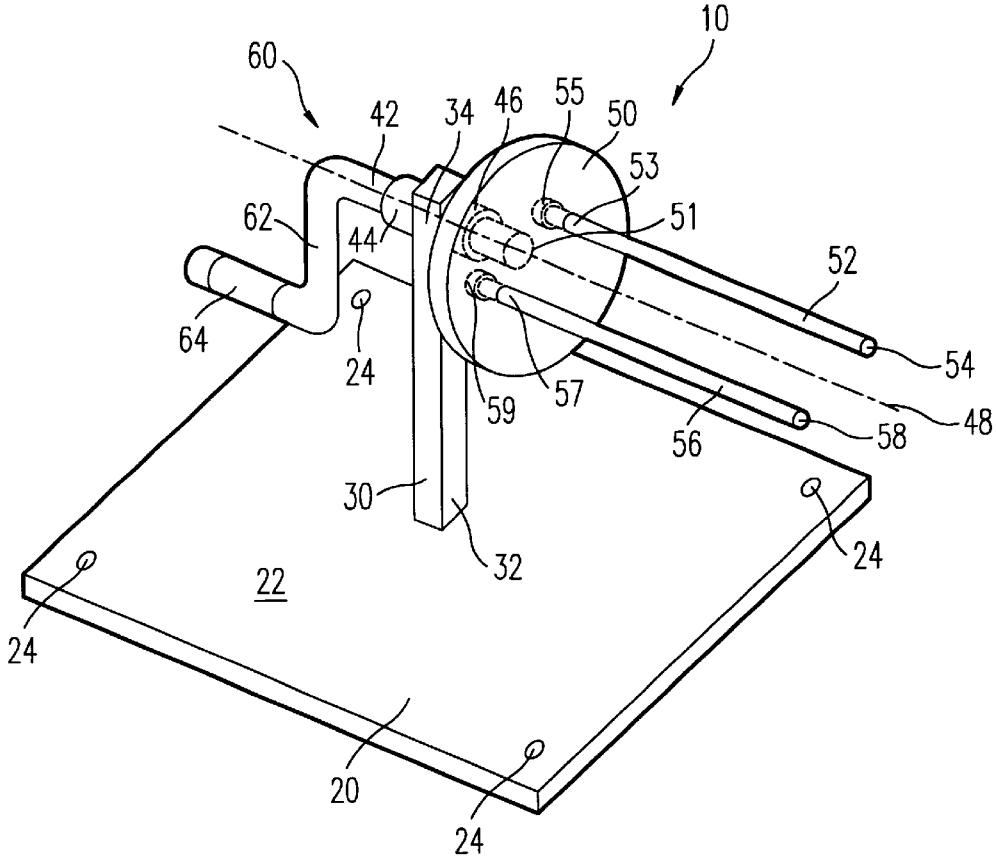
FIG. 1 is a perspective view of an embodiment of a rolling apparatus according to the present invention.

Referring now to the drawings, where like reference numerals identify the same or corresponding parts throughout the several views, FIGS. 1 through 4 depict various embodiments of a rolling apparatus according to the present invention. Additionally, FIGS. 5A through 5D depict a method of rolling and a method of packaging an item according to the present invention, FIGS. 6A and 6B depict an alternative method of packaging an item according to the present invention, and FIGS. 7A through 7D depict a method of bagging an item according to the present invention.

Figure 2:
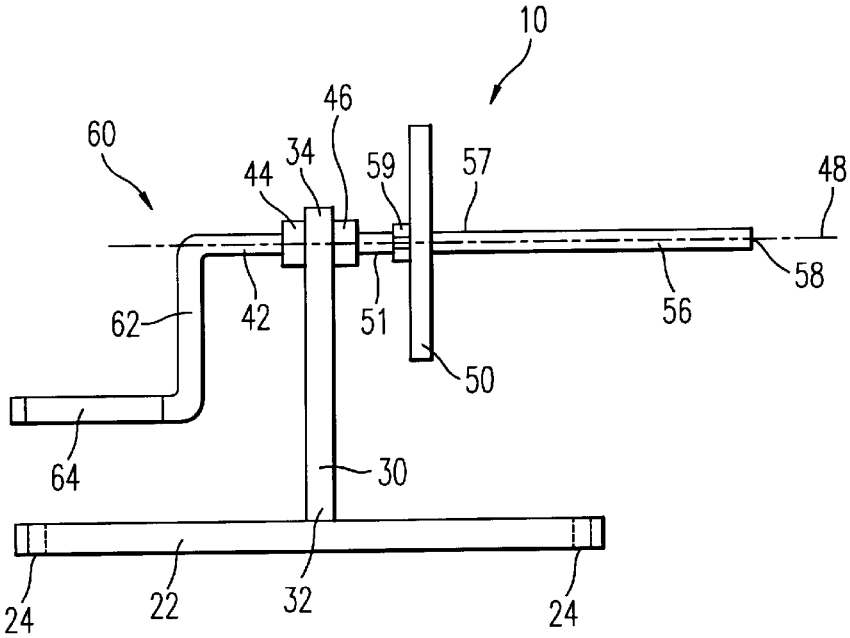
FIG. 2 is a side view of an embodiment of a rolling apparatus according to the present invention.

FIGS. 1 and 2 depict an embodiment of a rolling apparatus 10 according to the present invention. The apparatus 10 generally includes a first elongated projection 52, and a second elongated projection 56. The apparatus 10 preferably has a support structure including a base 20 and a bracket 30. The base 20 is preferably made of a rectangular sheet of metal, although the size, shape, and type of material used to construct the base 20 can be altered as will be readily apparent to one of skill in the art. The base 20 has an upper surface 22 upon which a lower end 32 of the bracket 30 is mounted. The base 20 preferably includes a plurality of holes 24 that can be used to detachably fix the apparatus 10 to a stationary structure using nuts and bolts (not depicted), or alternatively the base 20 can be secured to a table or other surface by a clamp. Alternatively, the base 20 can be constructed of a heavy material that acts as a weight to stabilize and mount the apparatus 10 on a surface without physically attaching the apparatus 10 to the support surface.

The bracket 30 has an upper end 34 having a hole therethrough that receives a shaft 42. The shaft 42 is configured to rotate within the hole in the upper end 34. The hole in the upper end 34 can include bearings in order to facilitate rotation of the shaft 42. The shaft 42 includes braces 44 and 46 fixed to the shaft 42 and positioned on either side of the upper end 34 of the bracket 30 in order to prevent the shaft 42 from sliding in an axial direction. In the preferred embodiment, the shaft 42 rotates about an axis 48. An end 51 of the shaft 42 is fixed to an end plate 50. In the preferred embodiment, the end plate 50 is a circular sheet of metal, although the size, shape, and type of material used to construct the end plate 50 can be altered as will be readily apparent to one of skill in the art. The preferred embodiment of the rolling apparatus 10 includes an end plate, although the end plate can be eliminated and the shaft 42 can be directly attached to the first and second elongated projections, 52 and 56, for example, by a rod or other connecting member. The end plate 50 is preferred since it can be used as an alignment device during the rolling process by aligning a side edge of the item being rolled against the end plate 50, as will be described in more detailed below with respect to FIGS. 5A and 5B.

The preferred embodiment of the rolling apparatus 10 includes a first elongated projection 52 and a second elongated projection 56. The elongated projections, 52 and 56, can be formed as cylindrical rods as depicted, as prongs or tines, as rods having different cross-sectional shapes and/or areas that either vary along the length thereof or have a constant cross-sectional shape and/or area along the length thereof, or as another similar configuration as will be readily apparent to one of skill in the art. The elongated projections can be formed of various materials, such as, metal, alloys, composite materials, plastics, woods, or other rigid or semi-rigid materials. Additionally, the elongated projections can be constructed of the same or different materials, sizes, and shapes. The preferred embodiment of the rolling apparatus 10 has two elongated projections, although additional elongated projections can be included. However, the additional elongated projections may create safety concerns for the workers, since additional elongated projections increase the likelihood a worker may have a limb or garment caught between the rotating elongated projections.

Figure 3:
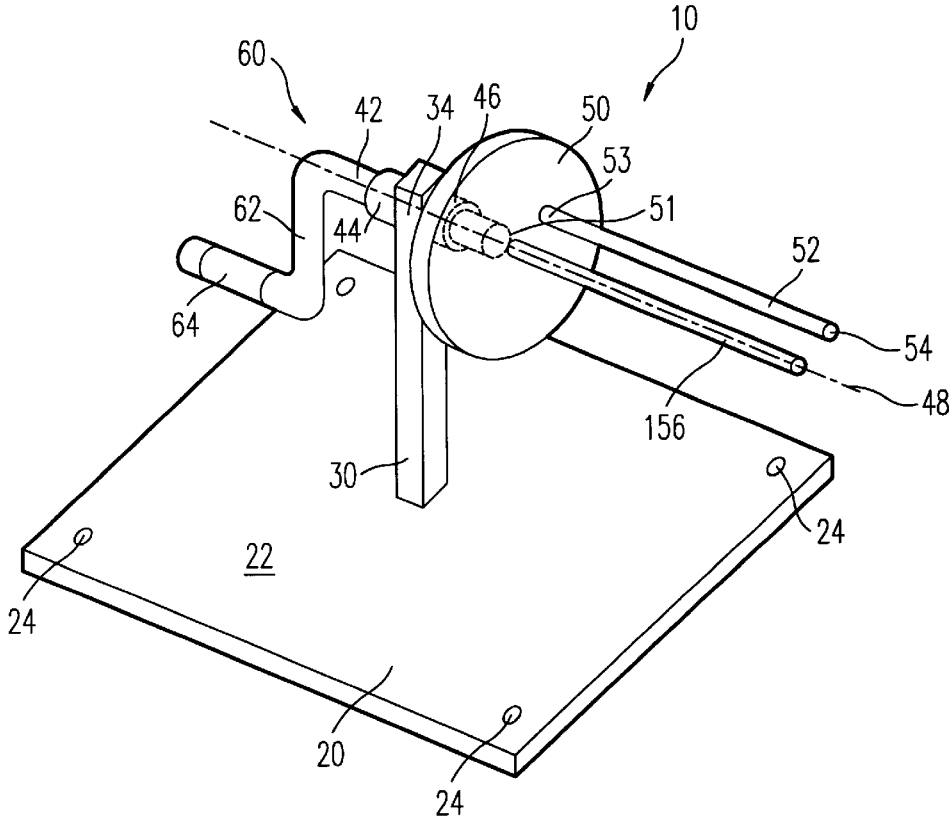
FIG. 3 is a side view of an alternative embodiment of a rolling apparatus according to the present invention.

In the preferred embodiment the elongated projections, 52 and 56, are oriented substantially in parallel with one another and are oriented perpendicularly to a plane of the end plate 50, although other configurations can be used as will be readily apparent to one of skill in the art. The first elongated projection 52 has an end 53 connected to the end plate 50 and a terminal end 54. The end 53 can be bolted to the end plate 50 by a bolt 55 as depicted or welded to the end plate 50, or connected to the end plate 50 in another rigid manner that is either detachable or non-detachable. FIGS. 1 and 2 depict a rolling apparatus 10 that includes first and second elongated projections 52 and 56 that are symmetrically positioned about the axis 48 such that projections 52 and 56 are offset from the axis 48 by an equal distance. Alternatively, the apparatus can have projections that are offset from the axis 48 by different distances, and/or are non-symmetrically positioned about the axis 48. FIG. 3 depicts an alternative embodiment where an elongated projection 52 is offset from the axis 48, and an elongated projection 156 extends along axis 48.

The first and second elongated projections, 52 and 56, are configured to rotate with respect to one another. Preferably, the first and second elongated projections, 52 and 56, are configured to rotate in unison about axis 48. In the embodiment depicted in FIGS. 1 and 2, the shaft 42 is attached to a crank 60 that can be used to manually or automatically (when combined with a device for actuating the crank 60) rotate the shaft 42. The crank 60 includes a crank arm 62 and a handle 64. The handle 64 is used to rotate the shaft 42, the end plate 50 and the elongated projections 52 and 56 by forcing the handle 64 about the axis 48.

Figure 4:
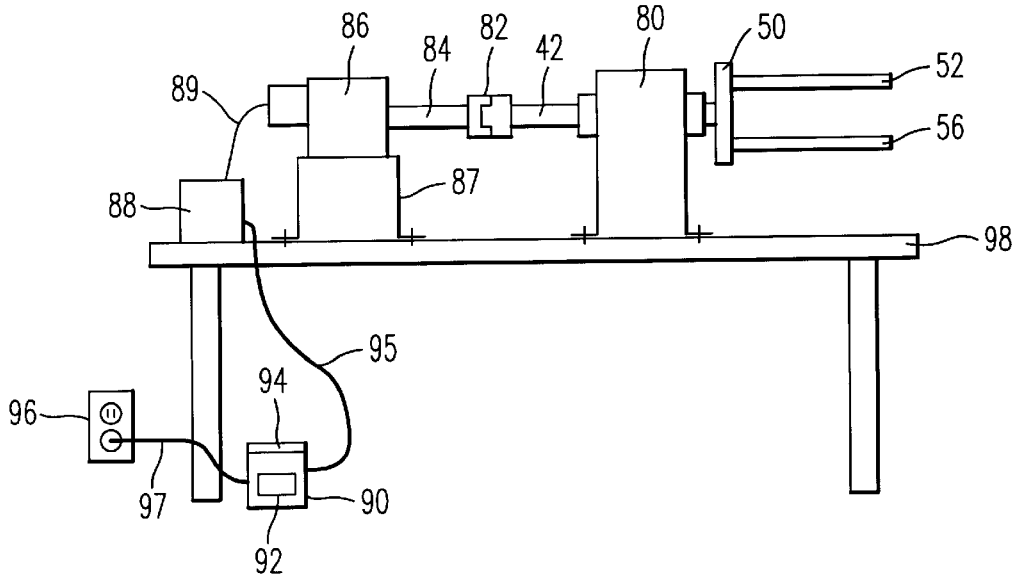
FIG. 4 is a side view of an alternative embodiment of a rolling apparatus according to the present invention.

FIG. 4 depicts an alternative embodiment of the present invention that includes a mechanized device for rotating the shaft 42. The invention includes a motor 86 configured to rotate the shaft 42, a controller 88, and an actuator 94. The embodiment depicted in FIG. 4 includes a support structure 80 configured to rotatably receive the shaft 42 and mounted on an upper surface of a table 98. The support structure 80 can be configured to include bearings to facilitate the rotation of the shaft 42. The shaft 42 is connected to a coupling 82 that connects the shaft 42 to an output shaft 84 of the motor 86, and that transfers the rotation of the output shaft 84 to the shaft 42. The motor 86 is mounted on a mounting bracket 87, which is mounted to the upper surface of the table 98. A controller 88 is connected to the motor 86 by wires 89. The controller 88 controls operating aspects of the motor 86, such as the speed of rotation of the output shaft 84. In the preferred embodiment a foot actuated switch 90 is included that is connected to the controller 88 by wires 95. The foot actuated switch 90 includes a foot pedal 92 and a protective guard 94 that covers the pedal 92 and prevents accidental actuation of the foot pedal 92. The system is connected to a power source outlet 96 by wires 97, thereby providing power to the foot actuated switch 90, the controller 88, and the motor 86. The rolling apparatus 10 depicted in FIG. 4 is operated by setting the controller 88 to the desired operating rotational speed and actuating the motor 86 using the foot pedal 92. The operator places an end of an elongated sheet of material between the first and second elongated projections, 52 and 56, and actuates the motor 86 to rotate shaft 42 and wind the sheet of material about the projections, as is discussed below with respect to FIGS. 5A and 5B.

Examples of parts used to construct the present invention includes a 90V DC gearmotor, such as a 30 RPM gearmotor having Grainger part number 2z809 and a Dayton 50 RPM DC gearmotor with nemal controller having Grainger part number 7z963, a 115V AC to 90V DC controller, a 115V AC power supply, connection parts, such as Grainger part numbers 1a417, 4x180, 1x409, and foot pedal parts, such as Grainger part numbers 5a288 and 5a289.

FIGS. 5A through 5D depict a method of rolling and a method of packaging an item according to the present invention. FIGS. 5A through 5D depict the rolling apparatus 10 of FIGS. 1 and 2, although the alternative embodiments can be utilized in a similar manner.

Figure 5A:
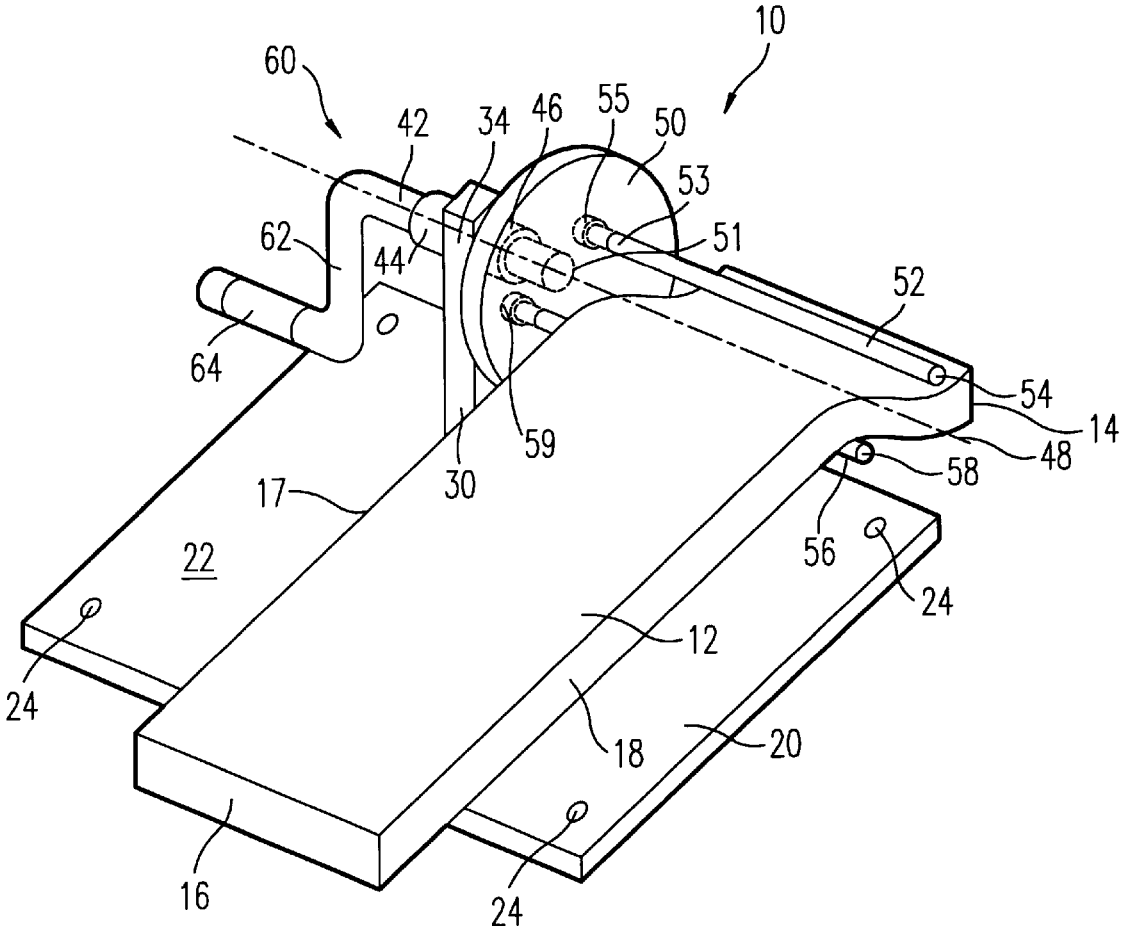
FIGS. 5A through 5D depict a method of rolling and a method of packaging an item according to the present invention.
Figure 6A:
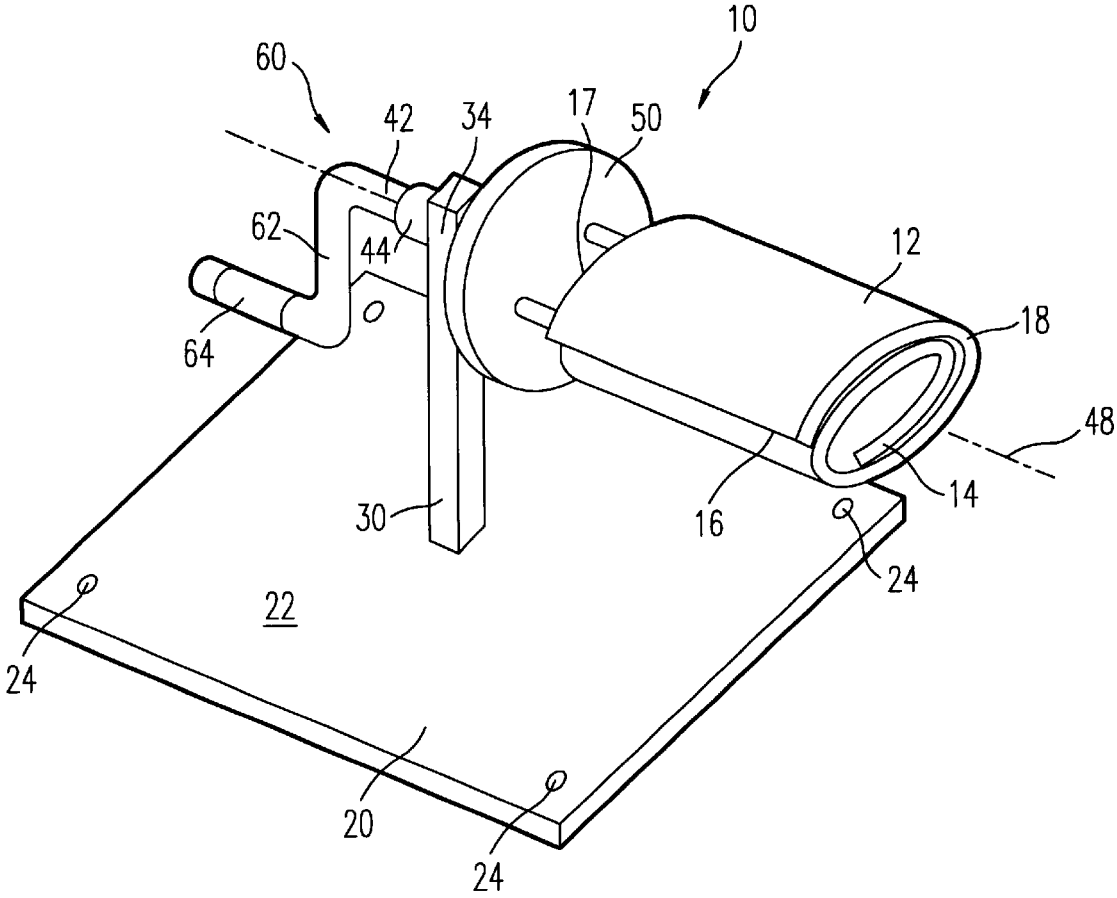
FIGS. 6A and 6B depict an alternative method of packaging an item according to the present invention.
Figure 6B:
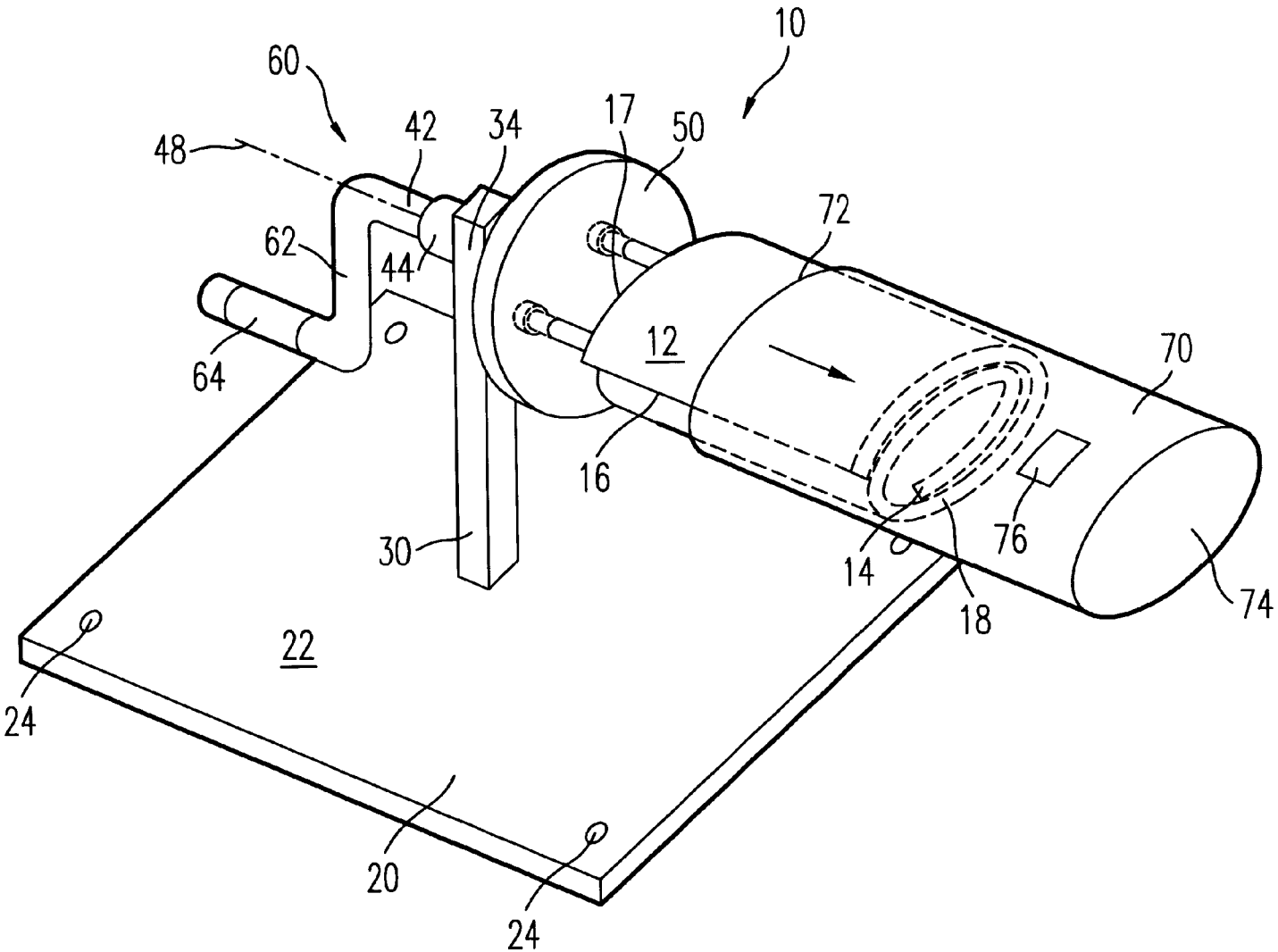

FIG. 5A depicts an elongated sheet of material 12, for example a sheet of fiberglas insulation, being inserted between the first elongated projection 52 and the second elongated projection 56. A leading end 14 of the sheet of material 12 is positioned between the first elongated projection 52 and the second elongated projection 56, and a side edge 17 is preferably positioned flush against the end plate 50. The end plate 50 helps align the sheet of material 12 properly in order to produce a neatly rolled item. Preferably the first and second elongated projections, 52 and 56, are equal or greater in length than the width of the sheet of material 12 from side edge 17 to an opposing side edge 18.

Figure 5B:
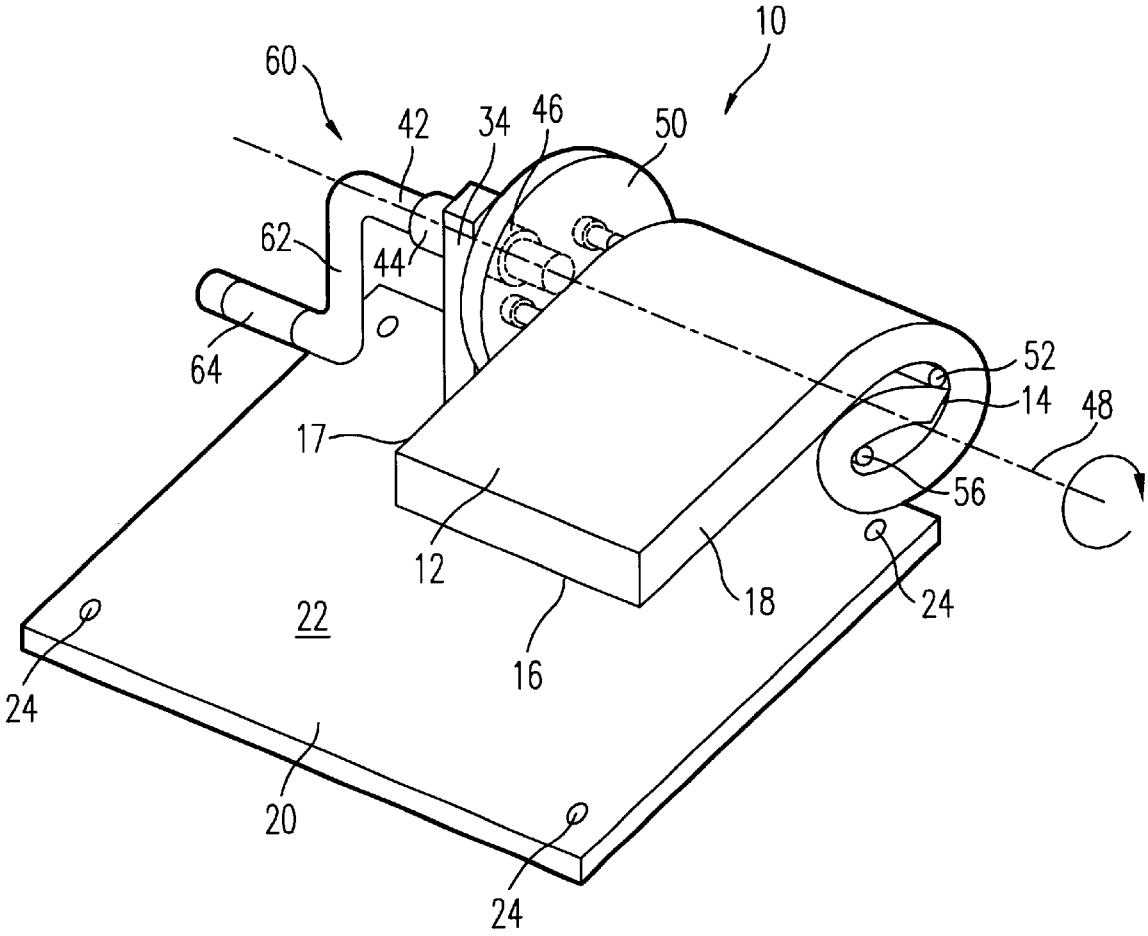

FIG. 5B depicts a step of rotating the first elongated projection 52 and the second elongated projection 56 with respect to one another to form a rolled item. In the embodiment depicted the shaft 42 is rotated and the first and second elongated projections, 52 and 56, twist the sheet of material 12 beginning with the leading end 14 and continuing until a trailing end 16 of the sheet of material is reached and the sheet of material 12 is fully rolled. The shaft 42 can either be rotated manually or using an device for automatically rotating the shaft 42, such as in the embodiment depicted in FIG. 4.

Figure 5C:
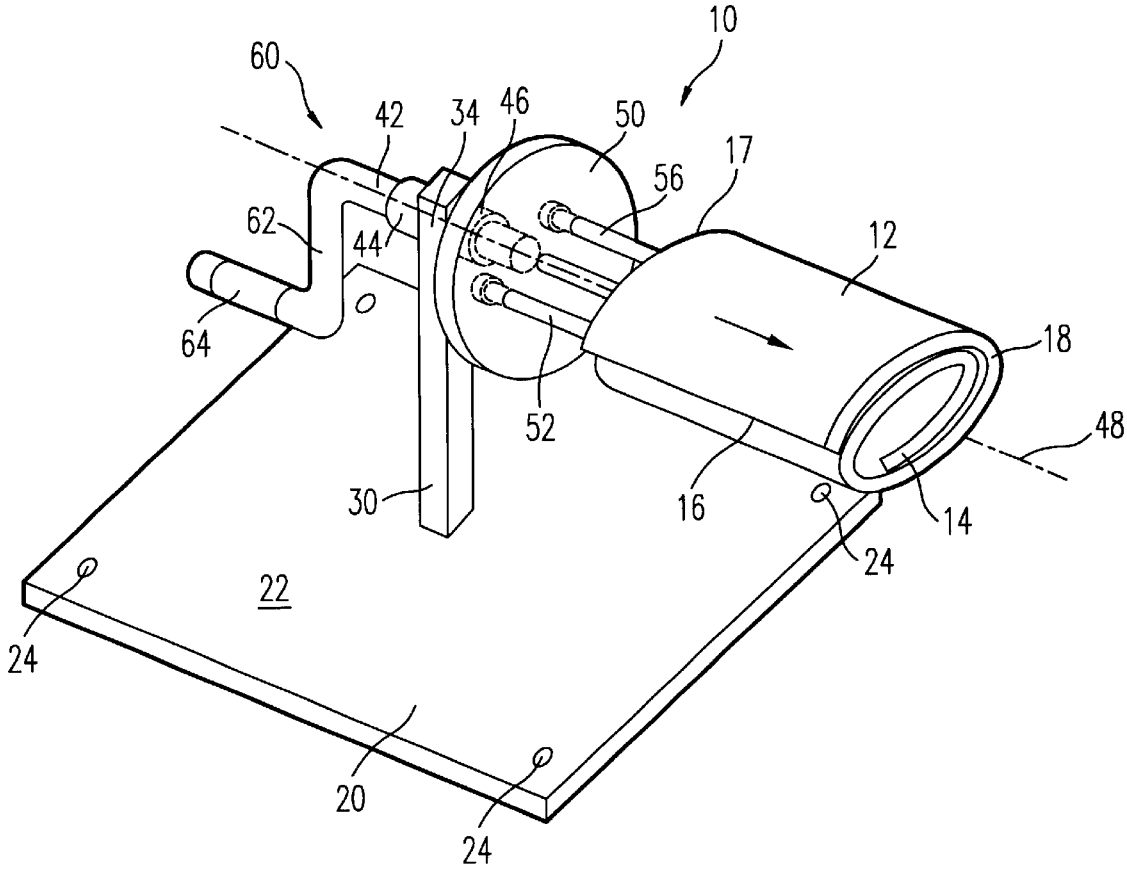
Figure 5D:
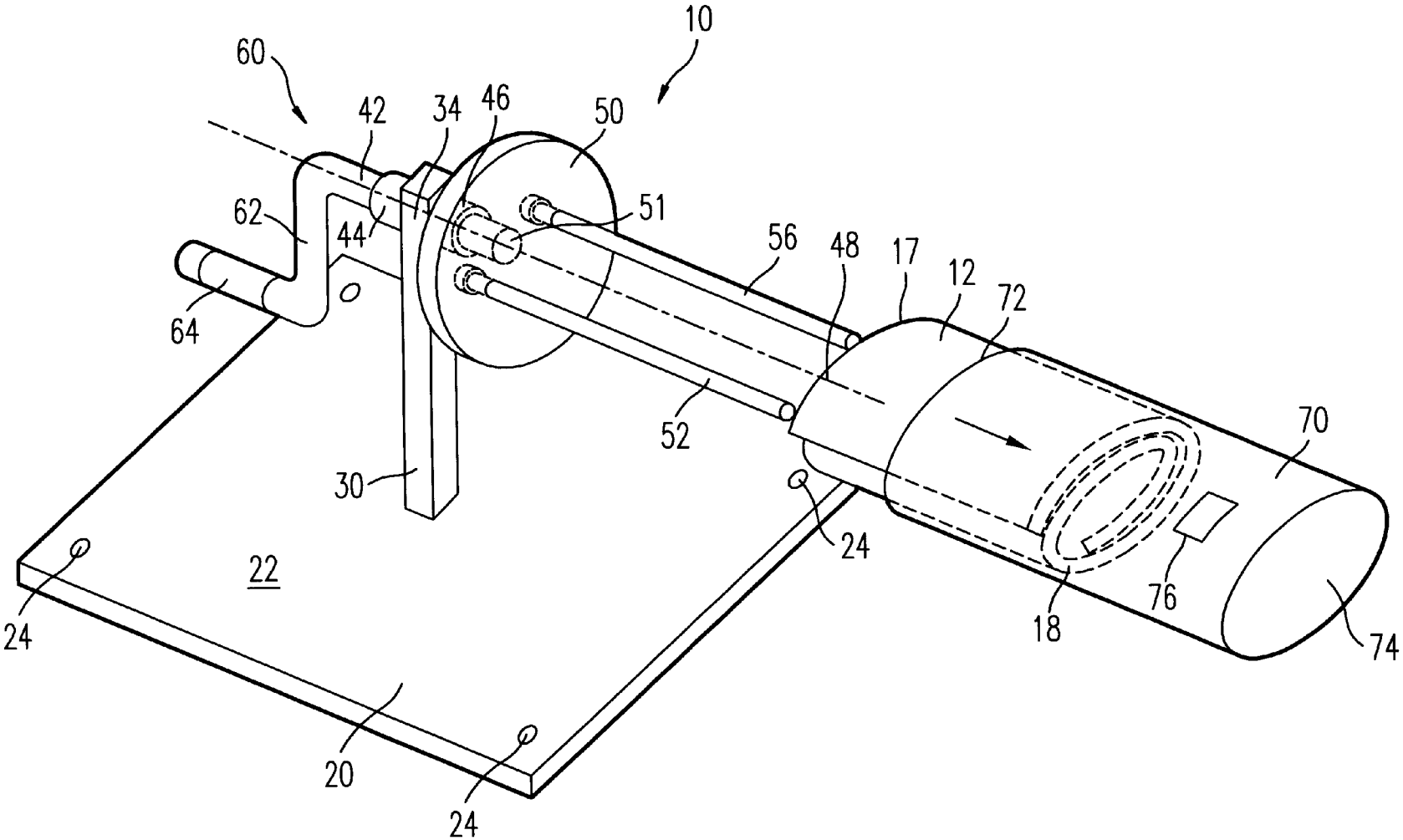

FIG. 5C depicts a step of removing the rolled item from the first and second elongated projections, 52 and 56, by sliding the rolled item in a direction parallel to the axis 48. The rolled item should slide smoothly off the first and second elongated projections, 52 and 56, and be ready for further processing or packaging. For example, the rolled item could then be inserted within an open end 72 of a receptacle 70, as depicted in FIG. 5D. The receptacle 70 can be configured as a bag having the open end 72 and a closed end 74 as depicted, or as a sleeve where end 74 is opened, rather than being closed. The receptacle 70 is shaped and sized dependent upon the shape and size of the item being packaged within the receptacle 70. The preferred embodiment of the receptacle 70 includes a transparent plastic bag having indicia 76 thereon labeling the product, which can be used also as a reference for orienting and aligning the item within the receptacle 70 in order to ensure the final product is aesthetically pleasing to the consumer.

FIGS. 6A and 6B depict an alternative method of packaging an item according to the present invention. In FIG. 6A, the rolled item remains on the first and second elongated projections, 52 and 56, following the rolling procedure as depicted in FIGS. 5A and 5B, and the receptacle 70 is slid over the rolled item prior to removal of the rolled item from the projections, 52 and 56. Once the receptacle 70 is positioned over the rolled item, the rolled item with the receptacle 70 is slid smoothly off the first and second elongated projections, 52 and 56, and the receptacle 70 and rolled item are ready for further processing or sealing of the receptacle 70.

In a preferred embodiment the step of inserting the rolled item into a receptacle, as depicted generally in FIG. 5D, is performed using a rolling apparatus and method as depicted in FIGS. 7A through 7D.

FIGS. 7A through 7D depict an embodiment of a bagging apparatus 210 according to the present invention. The apparatus 210 generally includes a main portion 220 having a tube section 222 and a flared section 240. The bagging apparatus 210 preferably includes a device configured to mount the apparatus on a stationary structure. A preferred embodiment of the mounting device 250 includes a base 258, and a bracket 252 connecting the base 258 to the main portion 220, such as to the tube section 222 or, alternatively, to the flared section 240. The apparatus preferably further includes a receptacle 70 configured to fit over an exterior surface 224 of the tube section 222 adjacent an opening 230.

The tube section 222 is generally hollow with an exterior surface 224 and an interior surface 226. The tube section 222 has a first opening 228 at one end thereof and a second opening 230 at an opposite end thereof. The first opening 228 is connected to the flared section 240, while the second opening 230 is generally configured to open into the receptacle 70 when a receptacle is positioned on a receptacle receiving portion 232 on the exterior surface 224 of the tube section 222 adjacent the second opening 230. The tube section 222 is preferably cylindrical in shape with a circular cross-section, however other shapes can be used. For example, the tube section 222 can be formed having a cross-section shape of any type of polygon, or any type of rounded shape, such as oval, elliptical, or another rounded shape. Additionally, the tube section 222 can be formed such that the cross-sectional shape and/or cross-sectional area varies along the length of the tube section 222 or maintains a constant cross-section shape and/or cross-sectional area along the length of the tube section 222, or a portion of the length thereof. The shape and size of the tube section 222 generally depends upon the shape of the item being inserted within the tube section 222 and the shape of the receptacle.

The flared section 240 is generally hollow with an exterior surface 242 and an interior surface 244. The flared section 240 has a wide opening 246 at one end thereof and a narrow opening 248 at an opposite end thereof. The wide opening 246 is generally configured to receive an item, while the narrow opening 248 is connected to the tube section 222. The flared section 240 is preferably formed in a truncated, conical shape, however other shapes can be used. For example, the flared section 240 can be formed having a cross-section shape of any type of polygon, or any type of rounded shape, such as oval, elliptical, or another rounded shape. Additionally, the flared section 240 can be formed such that the cross-sectional shape and/or cross-sectional area varies along the length of the flared section 240 or maintains a constant cross-section shape and/or cross-sectional area along the length of the flared section 240, or a portion of the length thereof. The shape and size of the flared section 240 generally depends upon the shape of the item being inserted within the flared section 240 and the shape of the tube section 222. The truncated, conical shape of the flared section 240 is preferred since it provides an angularly sloped conical interior surface 244 that smoothly guides the item to the narrow opening 248.

The tube section 222 and the flared section 240 are preferably made of metal, however, other materials can be used such as plastics, composite materials, metal alloys, etc. The tube section 222 and the flared section 240 can be formed of the same material, or can be formed of different materials. Preferably, the interior surface 226 of the tube section 222 and the interior surface 244 of the flared section 240 are smooth to allow the item to slide easily through the main portion 220. The interior surfaces 226 and 244 can be polished and/or coated with a low friction material in order to facilitate the sliding of the item through the main portion 220. In order to facilitate the sliding of the item through the main portion 220, the tube section 222 and the flared section 240 can be formed integrally with one another, for example, by forming the main portion using a mold such that the portion of the main portion 220 where the tube section 222 and the flared section 240 join is smooth. Alternatively, the tube section 222 and the flared section 240 can be integrally formed such that the tube section 222 and the flared section 240 are formed as one continuous conical surface.

The bagging apparatus 210 according to the present invention preferably includes a mounting device 250 configured to mount the apparatus on a stationary structure, such as a table, the ground, a flat surface, or another suitable structure. The mounting device 250 preferably includes a base 258, and a bracket 252 connecting the base 258 to the main portion 220, such as to the tube section 222 or, alternatively, to the flared section 240. The bracket 252 includes a first end 254 attached to the main portion 220, and a second end 256 attached to the base 258. The bracket 252 can be made fixed or detachable from the main portion 220 and the base 258, and can be constructed to be adjustable such that the height of the main portion 220 off the base 258 can be adjusted or the attachment location on the main portion 220 can be adjusted, if so desired. The mounting device 250 includes a plurality of holes 260 that can be used to detachably fixed the apparatus 210 to the stationary structure using nuts and bolts (not depicted), or alternatively the base 258 can be secured to a table or other surface by a clamp. Alternatively, the base 258 can be constructed of a heavy material that acts as a weight to stabilize and mount the apparatus 210 on a surface without physically attaching the apparatus 210 to the support surface.

The bagging apparatus 210 according to the present invention preferably further includes a receptacle 70 configured to fit over the receptacle receiving portion 232 on the tube section 222. The receptacle 70 can be configured as a bag having an open end 72 and a closed end 74 as depicted in FIGS. 1 and 2, or as a sleeve where end 74 is opened, rather than being closed. The receptacle 70 is shaped and sized dependent upon the shape and size of the item being packaged within the receptacle 70. The preferred embodiment of the receptacle 70 includes a transparent plastic bag having indicia 76 thereon labeling the product, which can be used also as a reference for orienting and aligning the item within the receptacle 70 in order to ensure the final product is aesthetically pleasing to the consumer.

Alternatively the bagging apparatus can include a main portion with a flared section that is formed having a curved interior surface and exterior surface. In such an embodiment, the curved interior surface smoothly joins with the interior surface of the tube section.

A method for inserting an item into a receptacle using a bagging apparatus according to the present invention will now be discussed with reference FIGS. 7A through 7D. The method for inserting an item into a receptacle is advantageous in that it provides a process for easily and neatly inserting an item into a receptacle.

Figure 7A:
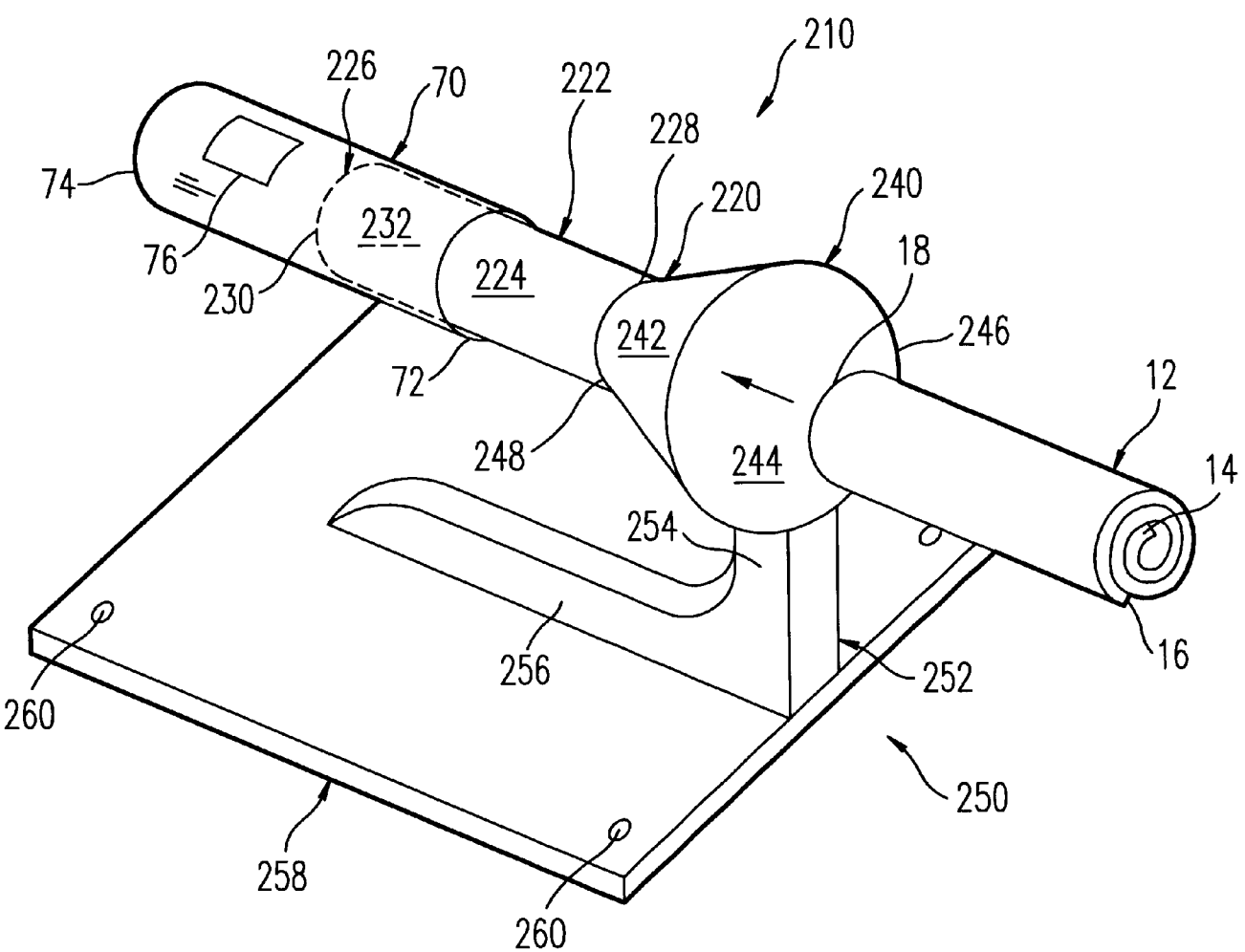
FIGS. 7A through 7D depict a method of bagging an item according to the present invention.

FIG. 7A depicts the bagging apparatus 210 mounted on a stationary support structure, such as a table top using a plurality of bolts and nuts (not depicted). The method of the present invention includes the step of positioning a receptacle 70 over an exterior surface 224 of the tube section adjacent the second opening 230. Preferably, the open end 72 of the receptacle 70 is positioned over the receptacle receiving portion 232 on the tube section 222. The item being inserted within the bagging apparatus 210 is a rolled item previously removed from the first and second elongated projections, 52 and 56, of the rolling apparatus 10.

The sheet of material 12 is rolled prior to insertion into the bagging apparatus 210. The sheet of material 12 depicted in FIG. 7A has been rolled in a counterclockwise direction (as viewed in FIG. 7A) with terminal edge or end 14 being in the interior of the roll and terminal edge or end 16 being on the exterior of the roll. The sheet of material is rolled so that the sheet of material can be inserted within the receptacle. Note, however, that if the rolled sheet of material is inserted directly into the receptacle within the use of the bagging apparatus, the rolled sheet of material will be difficult to insert since it is sized to fit snugly into the receptacle. This insertion process would require a single worker both holding open the receptacle and inserting the rolled sheet of material, or two workers acting in unison with one worker holding the receptacle and one worker inserting the rolled sheet of material. Such a process is very labor intensive. Additionally, during such a process a leading end 18 of the rolled sheet of material, especially at and adjacent end 16, would become be bent, frayed and deformed during the insertion process. The resulting packaged product would not be aesthetically pleasing to the consumer as the deformed rolled sheet of material is visible through the transparent plastic bag used as a receptacle. Accordingly, the present invention allows for the rolled sheet of material 12 to be neatly and easily inserted within the receptacle 70.

Figure 7B:
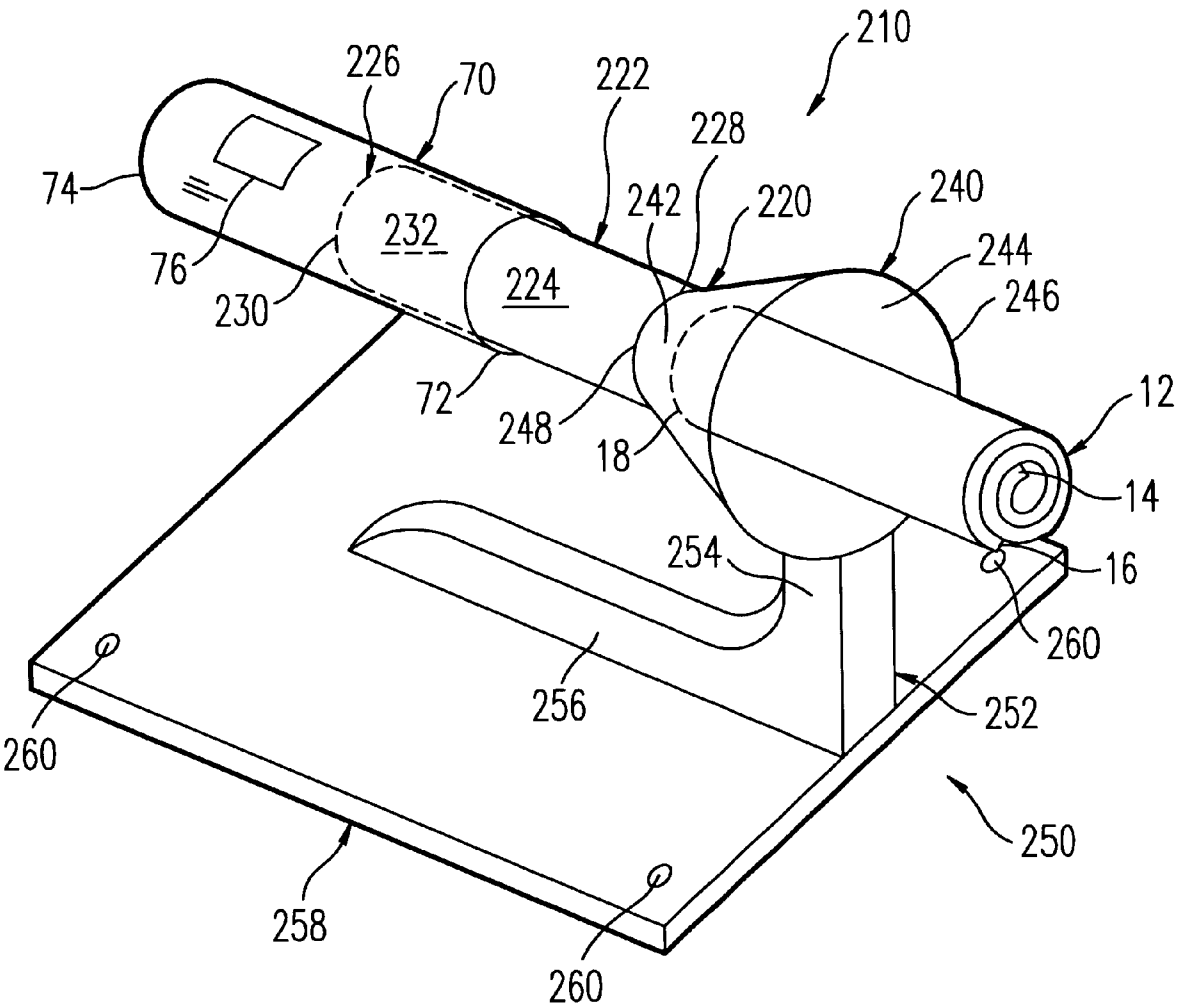

FIG. 7B depicts the rolled sheet of material 12 being inserted within the flared section 240 of the bagging apparatus 210 via the wide opening 246. The interior surface 244 of the flared section 240 guides the rolled sheet of material 12 towards the narrow opening 248. The rolled sheet of material 12 can be inserted within the flared section 240 without rotation or with rotation. Preferably the rolled sheet of material 12 is inserted within the flared section while rotating the sheet of material 12 in a clockwise direction as viewed in FIG. 7B. By rotating the rolled sheet of material 12 in a direction opposite the direction that rolled sheet of material is rolled, the terminal edge 16 of the rolled sheet of material 12 is maintained flat against the exterior surface of the rolled sheet of material 12. By using this method, the final product will be aesthetically pleasing to a consumer, since the rolled sheet of material 12 will be neatly inserted into the receptacle 70 without any frayed or deformed edges.

Figure 7C:
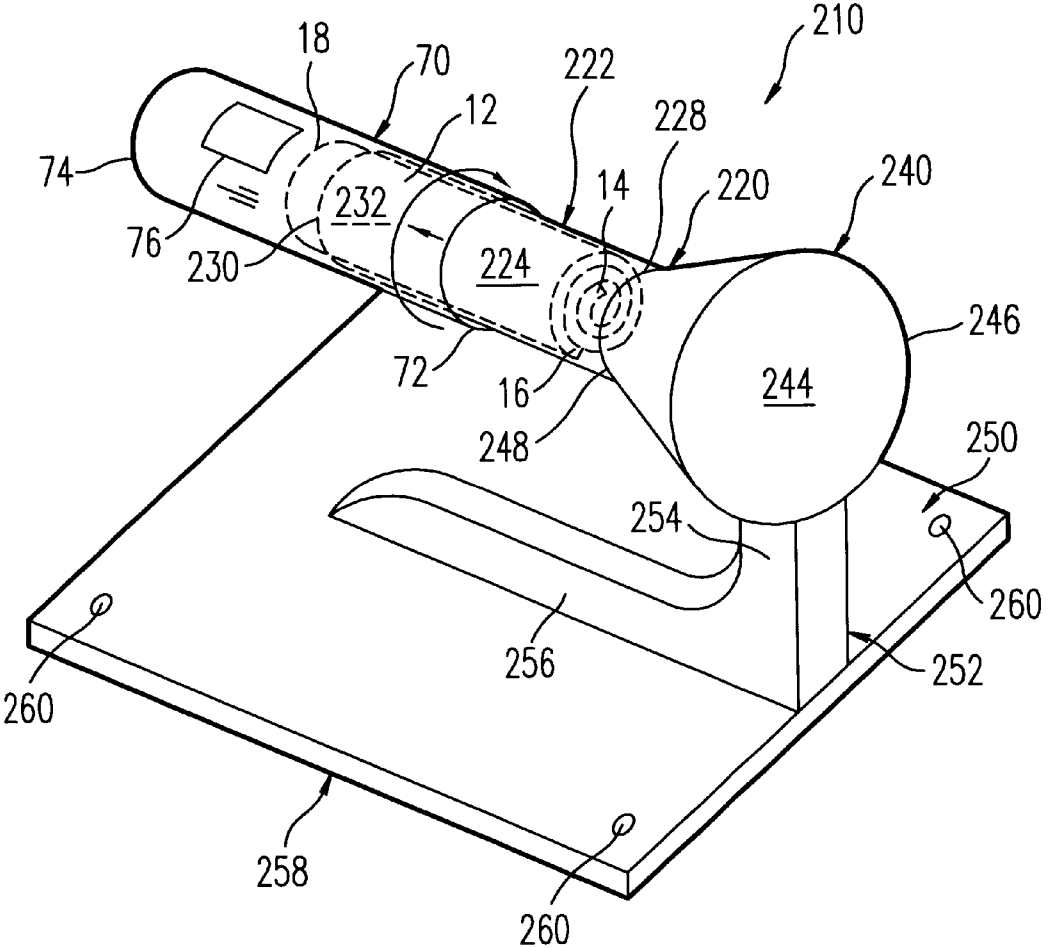
Figure 7D:
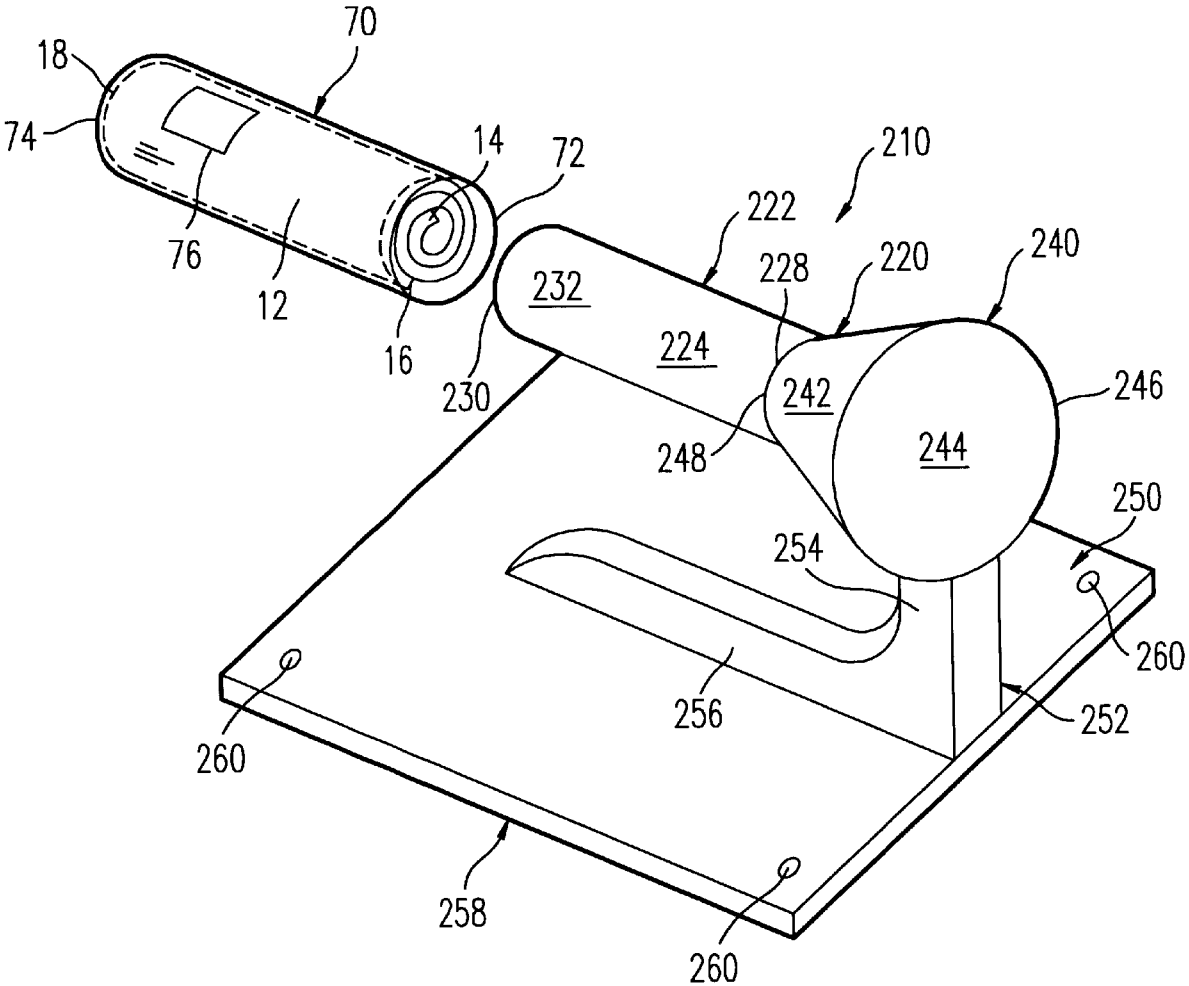

FIG. 7C depicts the rolled sheet of material 12 being slid through the narrow opening 248 of the flared section 240, through the tube section 222, and within the receptacle 70. The rolled sheet of material 12 can be slid without rotation or with rotation. Preferably the rolled sheet of material 12 is slid while rotating the sheet of material 12 in a clockwise direction as viewed in FIG. 7C. FIG. 7D depicts the rolled sheet of material 12 fully inserted within the receptacle 70. In order to produce a product that is aesthetically pleasing to a consumer, the method further includes the step of aligning the rolled sheet of material 12 at a predetermined orientation within the receptacle 70. This can be carried out by either rotating the rolled sheet of material 12 while it is in the tube section 222 or while it is in the receptacle 70. The rolled sheet of material 12 can be oriented at a predetermined orientation, for example, by orienting the end 16 at a predetermined position with respect to the indicia 76 on the receptacle 70. For example, by placing the end 16 at the rear of the receptacle 70, the consumer will view a smooth surface of the rolled sheet of material 12 on the front of the receptacle 70 where the labeling indicia is present. Once the rolled sheet of material 12 is positioned within the receptacle 70, the open end 72 can be sealed to form the final product.

Numerous variations of the present invention are possible in light of the above teachings. It is therefore to be understood that within the scope of the appended claims, the present invention can be practiced other than as specifically described herein.

What is new and desired to be secured by Letters Patent of the United States is:

1. A method for packaging an elongated item using an apparatus including a first elongated projection and a second elongated projection oriented substantially in parallel with the first elongated projection, said method comprising the steps of:

positioning an end of the item between the first elongated projection and the second elongated projection;

rotating the first elongated projection and the second elongated projection with respect to one another to form a rolled item; and inserting the rolled item into a receptacle, wherein the step of inserting the rolled item into a receptacle is performed using an apparatus having a hollow tube section having a first opening and a second opening and a hollow flared section having a narrow opening and a wide opening, the narrow opening being connected to the first opening, and wherein the step of inserting the rolled item into a receptacle comprises the steps of:

positioning the receptacle over an exterior surface of the tube section adjacent the second opening;

inserting the rolled item within the flared section via the wide opening; and sliding the rolled item through the narrow opening of the flared section, through the tube section, and within the receptacle, and wherein the rolled item is rolled such that a terminal edge of the elongated item is located on an exterior surface of the rolled item, and wherein said method further comprises the step of rotating the rolled item as the rolled item is inserted within the flared section, where the rolled item is rotated in a direction opposite a direction of rolling of the rolled item such that the terminal edge of the elongated sheet is maintained flat against the exterior surface of the rolled item.

2. The method according to claim 1, further comprising the step of sliding the rolled item off the first elongated projection and the second elongated projection prior to the step of inserting the rolled item into the receptacle.

3. The method according to claim 1, further comprising the step of sliding the roller item off the first elongated projection and the second elongated projection following the step of inserting the roller item into the receptacle.

4. The method according to claim 1, wherein said method further comprises the step of aligning the rolled item at a predetermined orientation within the receptacle.

5. A method for packaging an elongated item using an apparatus including a first elongated projection and a second elongated projection oriented substantially in parallel with the first elongated projection, said method comprising the steps of:

positioning an end of the item between the first elongated projection and the second elongated projection;

rotating the first elongated projection and the second elongated projection with respect to one another to form a rolled item; and inserting the rolled item into a receptacle, wherein the step of inserting the rolled item into a receptacle is performed using an apparatus having a hollow tube section having a first opening and a second opening and a hollow flared section having a narrow opening and a wide opening, the narrow opening being connected to the first opening, and wherein the step of inserting the rolled item into a receptacle comprises the steps of:

positioning the receptacle over an exterior surface of the tube section adjacent the second opening;

inserting the rolled item within the flared section via the wide opening; and sliding the rolled item through the narrow opening of the flared section, through the tube section, and within the receptacle, and wherein the rolled item is rolled such that a terminal edge of the elongated item is located on an exterior surface of the rolled item, and wherein said method further comprises the step of rotating the rolled item as the rolled item is slid through the tube section, where the rolled item is rotated in a direction opposite a direction of rolling of the rolled item such that the terminal edge of the elongated sheet is maintained flat against the exterior surface of the rolled item.

* * * * *